US007353563B2

(12) United States Patent
Blocker et al.

(10) Patent No.: US 7,353,563 B2
(45) Date of Patent: Apr. 8, 2008

(54) VACUUM CLEANER HEIGHT ADJUSTMENT

(75) Inventors: Douglas L. Blocker, Festus, MO (US); Keith R. Green, Bonneterre, MO (US); Richard J. Reis, St. Peters, MO (US)

(73) Assignee: Tacony Corporation, Fenton, MO (US)

( * ) Notice: Subject to any disclaimer, the term of this patent is extended or adjusted under 35 U.S.C. 154(b) by 635 days.

(21) Appl. No.: 10/888,287

(22) Filed: Jul. 9, 2004

(65) Prior Publication Data

US 2006/0005349 A1 Jan. 12, 2006

(51) Int. Cl.
*A47L 5/34* (2006.01)

(52) U.S. Cl. ..... 15/356

(58) Field of Classification Search ..... None
See application file for complete search history.

(56) References Cited

U.S. PATENT DOCUMENTS

| | | | |
|---|---|---|---|
| 1,348,585 | A | 8/1920 | Rosenfield |
| 1,482,946 | A | 2/1924 | Serva et al. |
| 1,482,953 | A | 2/1924 | Tideman |
| 1,733,384 | A | 10/1929 | Mross |
| 1,831,551 | A | 11/1931 | White |
| 1,850,710 | A | 3/1932 | Fairfax |
| 1,900,692 | A | 3/1933 | Clements |
| 1,904,974 | A | 4/1933 | Hoover |
| 2,067,990 | A | 1/1937 | Taylor |
| 2,104,453 | A | 1/1938 | Dow |
| 2,107,016 | A | 2/1938 | Synder |
| 2,712,669 | A | 7/1955 | Frere et al. |
| 2,734,217 | A | 2/1956 | Brace |
| 2,741,488 | A | 4/1956 | Ripple |
| 3,148,400 | A | 9/1964 | Wörwag |
| 3,217,351 | A | 11/1965 | Hayba |
| 3,262,147 | A | 7/1966 | Waters et al. |
| 3,346,896 | A | 10/1967 | Arones |
| 3,422,579 | A | 1/1969 | Rogge et al. |
| 3,608,333 | A | 9/1971 | Selley et al. |

(Continued)

FOREIGN PATENT DOCUMENTS

| | | |
|---|---|---|
| DE | 199 07 850 A1 | 2/1999 |

(Continued)

*Primary Examiner*—David A Redding
(74) *Attorney, Agent, or Firm*—Senniger Powers LLP

(57) ABSTRACT

A vacuum cleaner height adjustment mechanism including a cleaning head having a pair of laterally spaced front wheels and a pair of laterally spaced rear wheels mounted for rotation within the cleaning head for supporting the cleaning head on a floor during vacuum cleaning operations, the front wheels being mounted to a common axle mounted in the cleaning head for pivotal movement around a fixed axis, the wheels being mounted to the axle offset from the pivotal axis of the axle, an arm extending from the axle, a shaft mounted substantially horizontally in the cleaning head for rotation about a central axis disposed in a plane perpendicular to a plane containing the axis of the axle, one end of the shaft having spiral threads thereon and an opposite end having an adjustment knob fixed thereto for manually rotating the shaft, and a guide member having internal threads matching and engaged with the spiral threads on the shaft for movement along the shaft, the guide member being coupled to the arm extending from the axle so as to pivot the axle when the shaft is rotated by rotating the knob, whereby the front wheels are raised or lowered relative to the cleaning head.

5 Claims, 8 Drawing Sheets

U.S. PATENT DOCUMENTS 3,654,661 A 4/1972 Scott
3,683,448 A 8/1972 Lagerstrom et al.
3,818,540 A 6/1974 Martinec et al.
3,909,874 A 10/1975 Clowers et al.
3,936,903 A 2/1976 Johnson
3,959,846 A 6/1976 Yasuda
4,083,079 A 4/1978 Vermillion
4,167,801 A 9/1979 Erbor et al.
4,199,839 A 4/1980 Martinec
4,342,132 A 8/1982 Fromknecht
4,351,078 A 9/1982 Sternberg
4,391,018 A * 7/1983 Vermillion et al. ..... 15/339
4,437,205 A 3/1984 Koland
4,446,594 A 5/1984 Watanabe et al.
4,467,495 A 8/1984 Fish et al.
4,706,327 A 11/1987 Getz et al.
5,056,175 A 10/1991 Stein
5,522,114 A 6/1996 Allison
6,081,963 A 7/2000 Jailor et al.
6,357,076 B1 3/2002 Lee

FOREIGN PATENT DOCUMENTS

GB 2 074 850 A 11/1981

* cited by examiner

VACUUM CLEANER HEIGHT ADJUSTMENT

BACKGROUND OF THE INVENTION

The present invention relates to a vacuum cleaner height adjustment mechanism and, more particularly, to a height adjustment mechanism that is particularly useful in the cleaning head of an upright vacuum cleaner and which elevates the front portion of the cleaning head containing a carpet agitator.

Upright type vacuum cleaners generally include a cleaning head and a pivotably-mounted elongated handle and dust storage compartment extending upwardly therefrom. The handle is generally grasped by the user to propel the cleaning head over a surface to be cleaned. The cleaning head is generally provided with ground-engaging wheels to provide for easier movement over the surface to be cleaned. The cleaning head typically includes an agitator brush rotatably mounted in a forward portion of the cleaning head. The agitator brush is typically mounted adjacent a suction inlet in the cleaning head which receives any dirt and debris loosened by the action of the agitator brush. Suction is applied to the inlet and the dirt and debris are then collected in the dust storage compartment for later disposal.

Vacuum cleaners are often used to clean both bare floors and carpets having varying thicknesses and pile characteristics. Thus, it is desirable to provide the vacuum cleaner with a height adjustment mechanism which positions the height of the suction inlet and agitator brush relative to the surface to be cleaned so as to dislodge the greatest amount of dirt and debris therefrom. Many such mechanisms can only be adjusted when the main body of the vacuum cleaner is in the vertical position which can be inconvenient during use.

SUMMARY OF THE INVENTION

Some aspects of the present invention overcome the above described difficulties and disadvantages of prior art vacuum cleaner height adjustment mechanisms by providing such a mechanism which does not require the main body of the vacuum cleaner to be in the vertical position before adjusting the mechanism. In a further advantage of some aspects of the present invention the mechanism can act as a shock absorber when the vacuum cleaner is set down hard on the cleaning head thus reducing the potential for damage of the vacuum cleaner.

In one aspect of the present invention a vacuum cleaner height adjustment mechanism is provided, comprising a cleaning head having a pair of laterally spaced front wheels and a pair of laterally spaced rear wheels mounted for rotation within the cleaning head for supporting the cleaning head on a floor during vacuum cleaning operations, the front wheels being mounted to a common axle mounted in the cleaning head for pivotal movement around a fixed axis, the wheels being mounted to the axle offset from the pivotal axis of the axle, an arm extending from the axle, a shaft mounted substantially horizontally in the cleaning head for rotation about a central axis disposed in a plane perpendicular to a plane containing the axis of the axle, one end of the shaft having spiral threads thereon and an opposite end having an adjustment knob fixed thereto for manually rotating the shaft, and a guide member having internal threads matching and engaged with the spiral threads on the shaft for movement along the shaft, the guide member being coupled to the arm extending from the axle so as to pivot the axle when the shaft is rotated by rotating the knob, whereby the front wheels are raised or lowered relative to the cleaning head.

Another aspect of the present invention also preferably includes an indexing block fixedly secured to the cleaning head and having a cylindrical opening therethrough, the shaft passing through the cylindrical opening in the indexing block, an indexing washer having a central opening through which the shaft extends, the indexing washer being fixed to the shaft for rotation therewith, a spring urging the indexing washer into engagement with the indexing block. The indexing block and the indexing washer preferably have at least one cooperating detent and indent disposed radially around the axis of the shaft for holding the shaft in a fixed position after manual rotation.

A further aspect of the present invention also preferably includes the cleaning head having a substantially vertical rear surface with the knob extending out through the rear surface of the cleaning head so as to be accessible for manual rotation.

Still other aspects of the present invention will become apparent to those skilled in this art from the following description wherein there is shown and described a preferred embodiment of this invention, simply by way of illustration of one of the modes best suited to carry out the invention. As it will be realized, the invention is capable of other different embodiments and its several details are capable of modification in various aspects all without departing from the invention. Accordingly, the drawings and descriptions will be regarded as illustrative in nature and not as restrictive.

DETAILED DESCRIPTION OF THE PREFERRED EMBODIMENT

Figure 1:
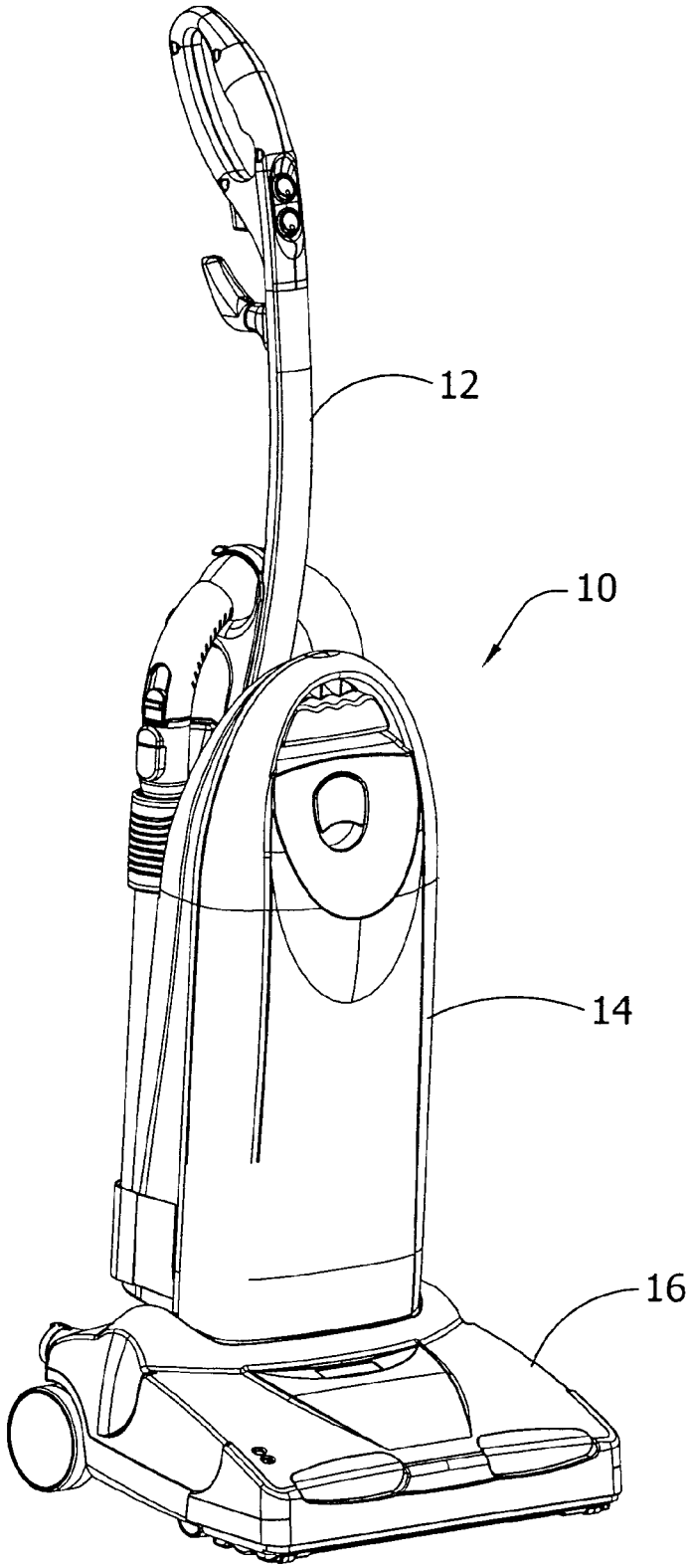
FIG. 1 is a front prospective view of a vacuum cleaner utilizing a preferred embodiment of the present invention.
Figure 2:
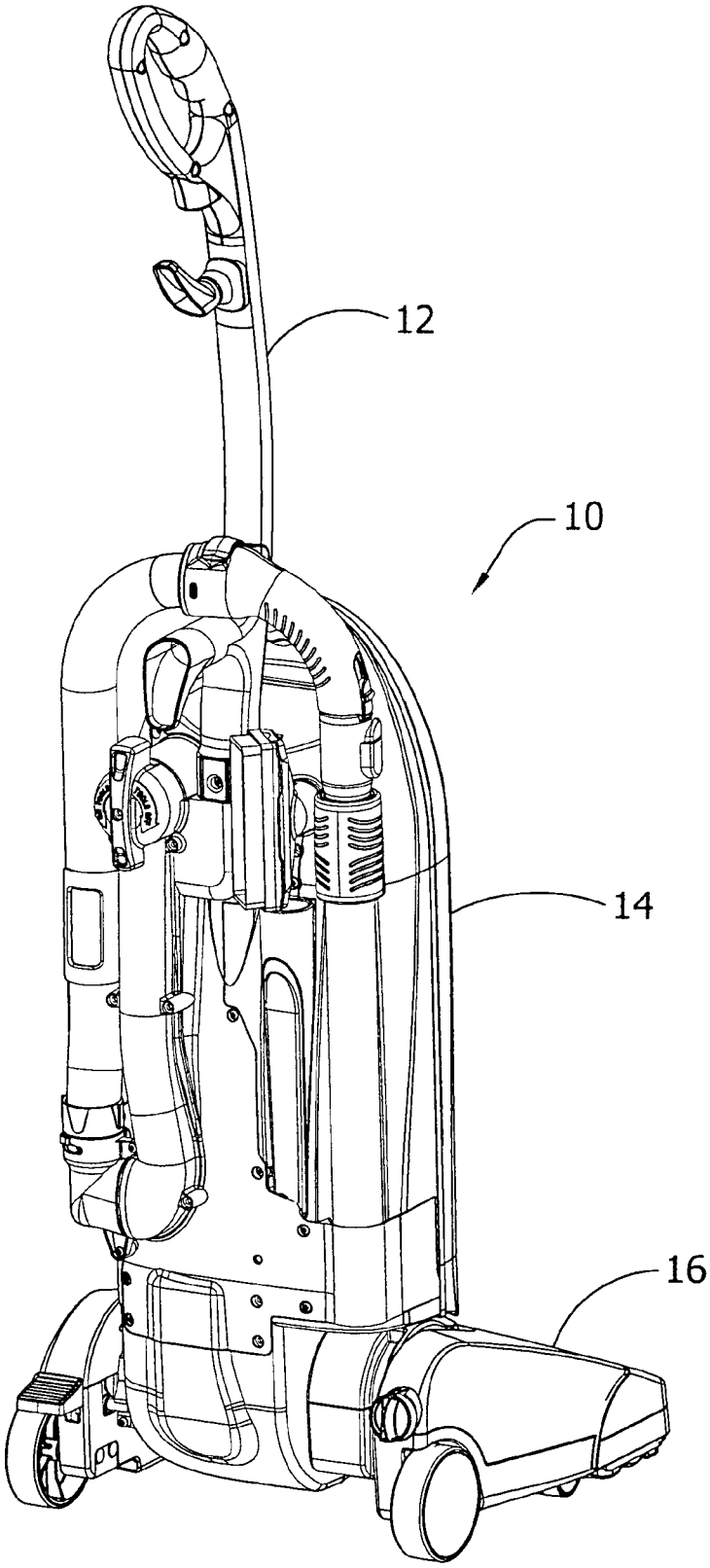
FIG. 2 is a rear perspective view of the vacuum cleaner of FIG. 1.
Figure 3:
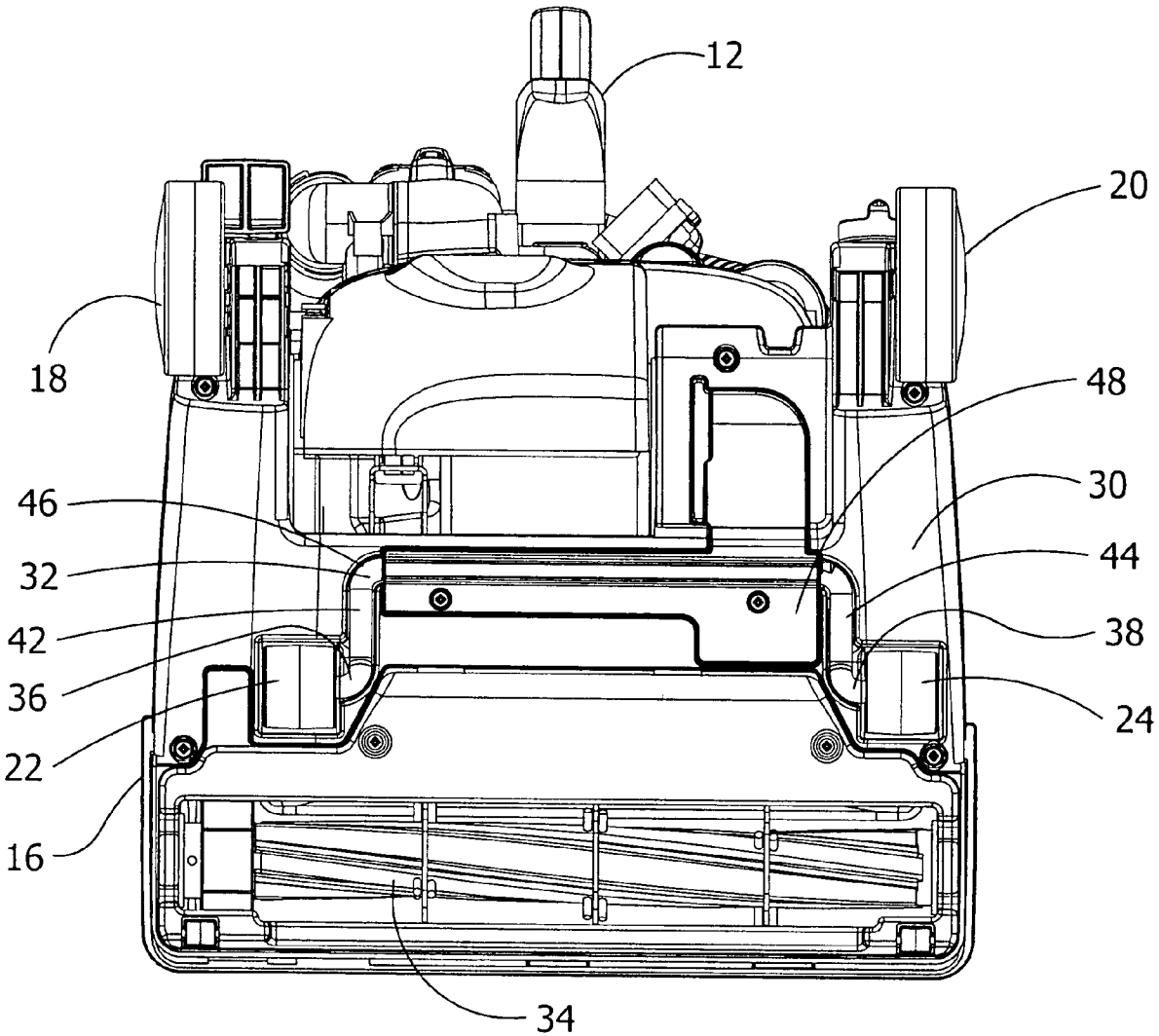
FIG. 3 is a bottom view of the vacuum cleaner of FIG. 1.

Referring to FIGS. 1 and 2, an upright vacuum cleaner 10 constituting a preferred embodiment of the present invention is shown having a handle 12 extending out of and connected to a main body 14. The main body 14 is pivotally connect to a cleaning head 16 so that the handle 12 can be pivoted in a vertical plane as is generally well known in the art in order to maneuver the cleaning head over a surface to be cleaned. As shown in FIG. 3, the cleaning head is supported by a pair of rear wheels 18 and 20 and a pair of front wheels 22 and 24. The rear wheels are mounted for rotation to fixed spindles which are mounted to a main body 30 of the cleaning head 16. The front wheels 22 and 24 are mounted to opposite ends of an axle 32 which is pivotally mounted in the cleaning head 16 main body 30 as described more fully below. Mounted for rotation in the front of the cleaning head 16 just in front of the wheels 22 and 24 is a brush roller 34 for agitating the dust on a surface to be cleaned so that the dust can be picked up by a vacuum source (not shown) disposed directly behind the brush roller 34. In the preferred embodiment the brush roller 34 is rotated by a motor (not shown). The wheels 22, 24, 26 and 28 support the cleaning head 16 and thus the entire upright vacuum cleaner 10 for movement over surfaces to be cleaned. Since these surfaces vary from hard floors to thick carpet, it is necessary to be able to adjust the height of the cleaning head in the area of the brush roller 34 so that the brush roller properly engages the surface to be cleaned.

Figure 7:
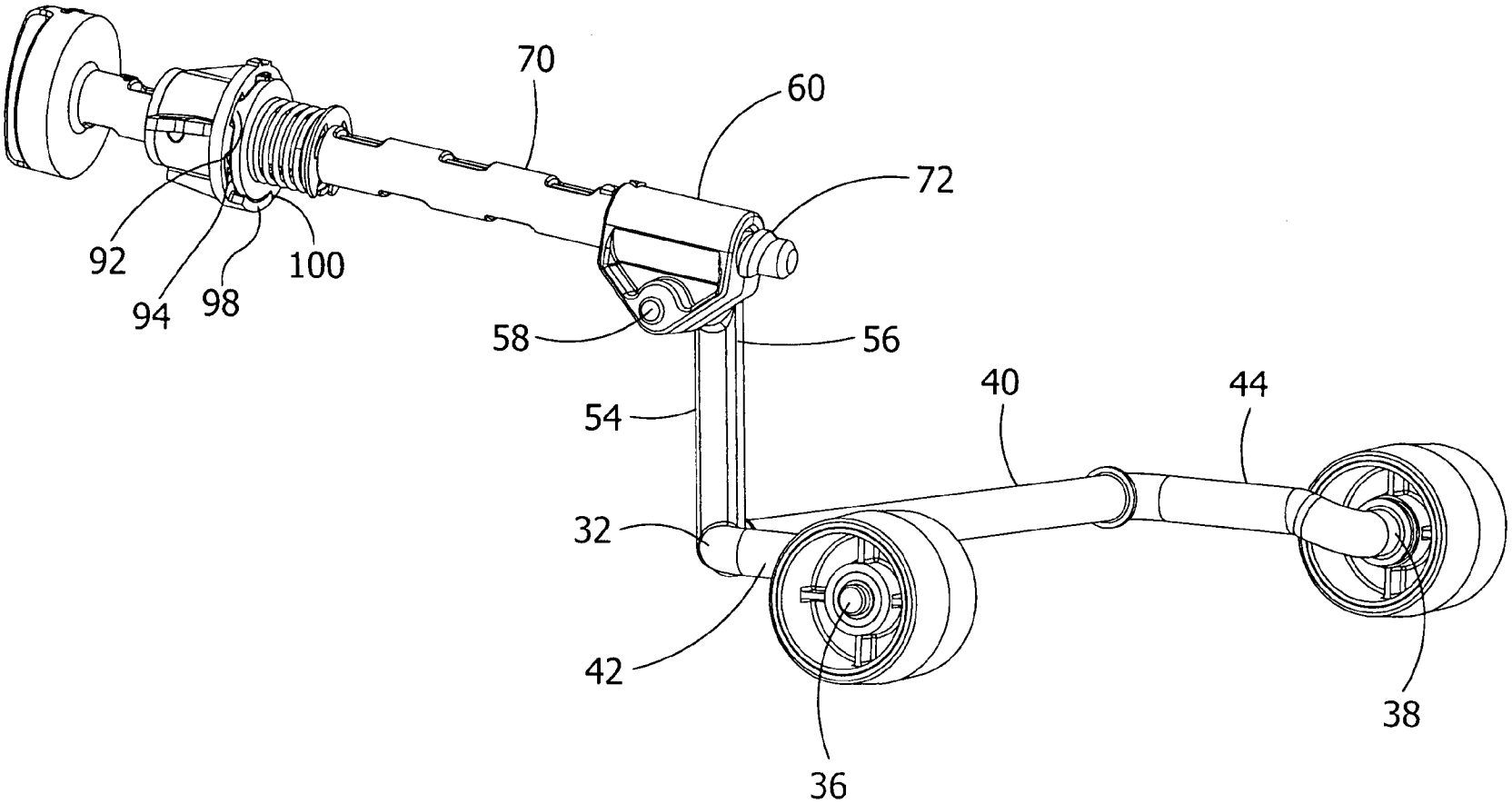
FIG. 7 is a perspective view of the height adjustment mechanism of the preferred embodiment.
Figure 8:
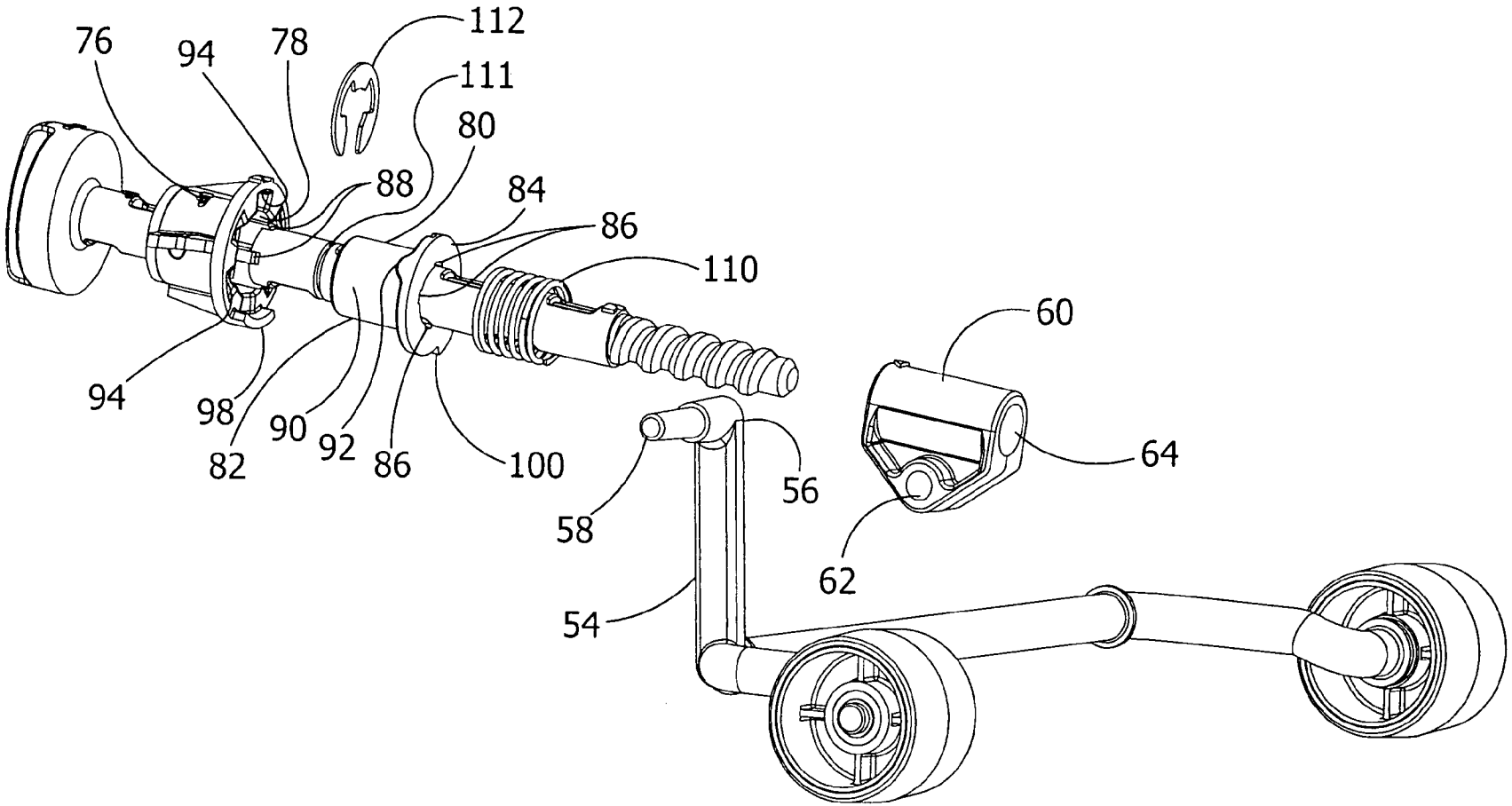
FIG. 8 is an expanded perspective view of the height adjustment mechanism of the preferred embodiment.

In the preferred embodiment, the axle 32 (see FIGS. 3 and 7) is generally U-shaped and is mounted for pivotal movement within the cleaning head 16. The opposite outer ends of axle 32 form spindles 36 and 38 on which the front wheels 22 and 24 are, respectively, mounted and which spindles are axially aligned and together are offset from the rotational axis of a central portion 40 of axle 32. Spindles 36 and 38 are connected to axle central portion 40 by extensions 42 and 44, respectively. The central portion 40 of axle 32 is received in a semi-cylindrical recess 46 formed in the bottom of main body 30 of cleaning head 16 and is held in position by a bracket 48 covering recess 46 so as to contain central portion 40 of axle 32 for rotational movement. A lever arm 54 is fixed to, such as by welding, and extends radially from central portion 40 of axle 32 at one side thereof. The outer end 56 of lever arm 54 is provided with a spindle 58 with a central longitudinal axis parallel to the axis of central portion 40 of axle 32. A guide member 60 is pivotally mounted to spindle 58 through cylindrical bore 62 formed therein. Guide member 60 is provided with an internal cylindrical bore 64 transverse to cylindrical bore 62 with internal spiral threads 66.

A shaft 70 has spiral threads 72 formed at one end thereof which threads are matingly received by corresponding internal spiral threads 66 formed in cylindrical bore 64 of guide member 60. An opposite end 74 of shaft 70 is received in a stationary indexing block 76 mounted to the main body 30 of cleaning head 16, such as by screws. Shaft 70 is free to rotate in a cylindrical bore 78 formed in block 76. An indexing member 80 is formed with a cylindrical tubular main body 82 and an annular radially extending lip 84. The internal cylindrical surface of the tubular main body 82 is provided with axially extending grooves 86 which receive axially extending keys 88 formed on the outer cylindrical surface of shaft 70 so that shaft 70 and indexing member 80 rotate together within block 76 while the indexing member 80 is free to slide on keys 88 longitudinally along shaft 70. The outer cylindrical surface 90 of tubular main body 82 of member 80 is received in cylindrical bore 78 formed in block 76 so that the shaft 70 and member 80 are supported for rotation within block 76. Radially extending lip 84 is provided with at least one indexing detent 92 in the form of a semi-cylindrical radially extending protrusion formed on the surface of lip 84. A plurality of radially extending indexing indents 94 are formed at equally spaced intervals around the inside surface of cylindrical bore 78 at the end of indexing block 76 so that as the shaft 70 is rotated the indexing detent 92 can be aligned with one of the indents 94. An indexing stop member 98 in the shape of an axially extending radially curved surface is formed in indexing block 76. A similar stop member 100 in the form of a radially extending lip is formed on annular lip 84. The radially extending end surface on stop member 100 of indexing member 80 engages the axially extending end surface on stop member 98 on indexing block 76 at one limit of rotation of shaft 70 and the radially extending end surface on the opposite side of stop member 100 of indexing member 80 engages the axially extending end surface formed on the opposite side of stop member 98 of indexing block 76 at an opposite end of rotation of shaft 70. Thus, the shaft 70 is prevented from being rotated in either direction beyond this limited movement.

A helical spring 110 is mounted on shaft 70 and engages annular lip 84. It is held against lip 84 by an E-ring 112 fitted into a corresponding groove 111 in the outer cylindrical surface of shaft 70. Spring 110 is lightly compressed so as to urge indexing member 80 into engagement with indexing block 76 and to cause the detent 92 to enter one of the indents 94 as the shaft 70 is rotated and to maintain the detent in the indent until the shaft is again manually rotated.

Figure 4:
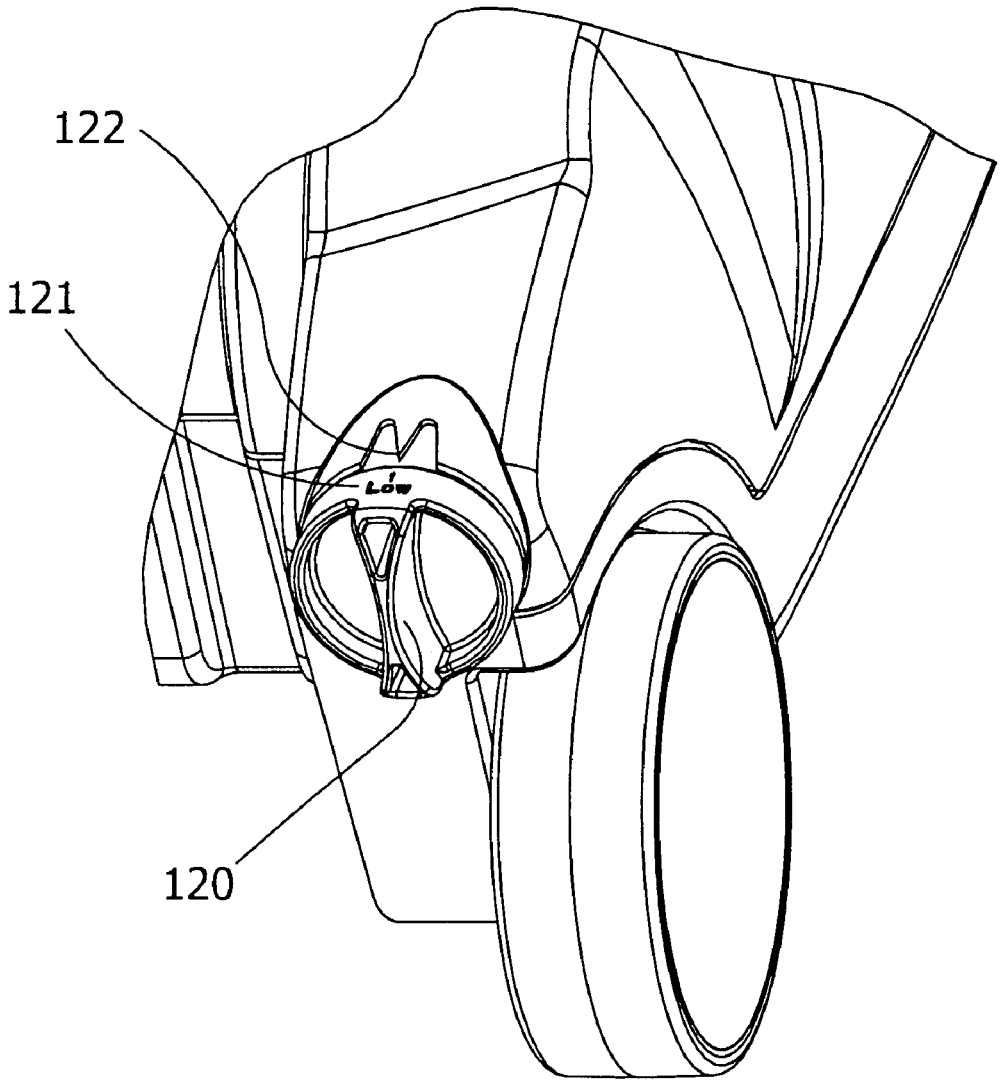
FIG. 4 is an enlarged perspective view of a rear portion of the cleaning head of the vacuum cleaner utilizing the preferred embodiment.

On the outer end of shaft 70 is a knob 120 which is fixed to the shaft for rotation therewith in order to manually rotate the shaft 70. As shown in FIGS. 2 and 4 the rear outer surface of cleaning head 16 is generally vertical and the knob 120 extends out from that surface so as to be accessible for manual rotation. The knob 120 can be provided with numbers or other indicia, such as "high" and "low" 121 corresponding with detent engagement positions when the knob is rotated. A pointer 122 can also be formed in or printed on the upper surface of the cleaning head 16 as a guide for positioning the knob 120.

Because spring 110 urges indexing member 80 into engagement with indexing block 76 it is not essential that the detent mechanism explained above be utilized although it is preferred. In addition, as noted above, the spring 110 acts as a shock absorber when the vacuum cleaner is dropped or roughly placed on a floor, thus reducing the possibility of damaging the vacuum cleaner in such conditions.

Figure 5:
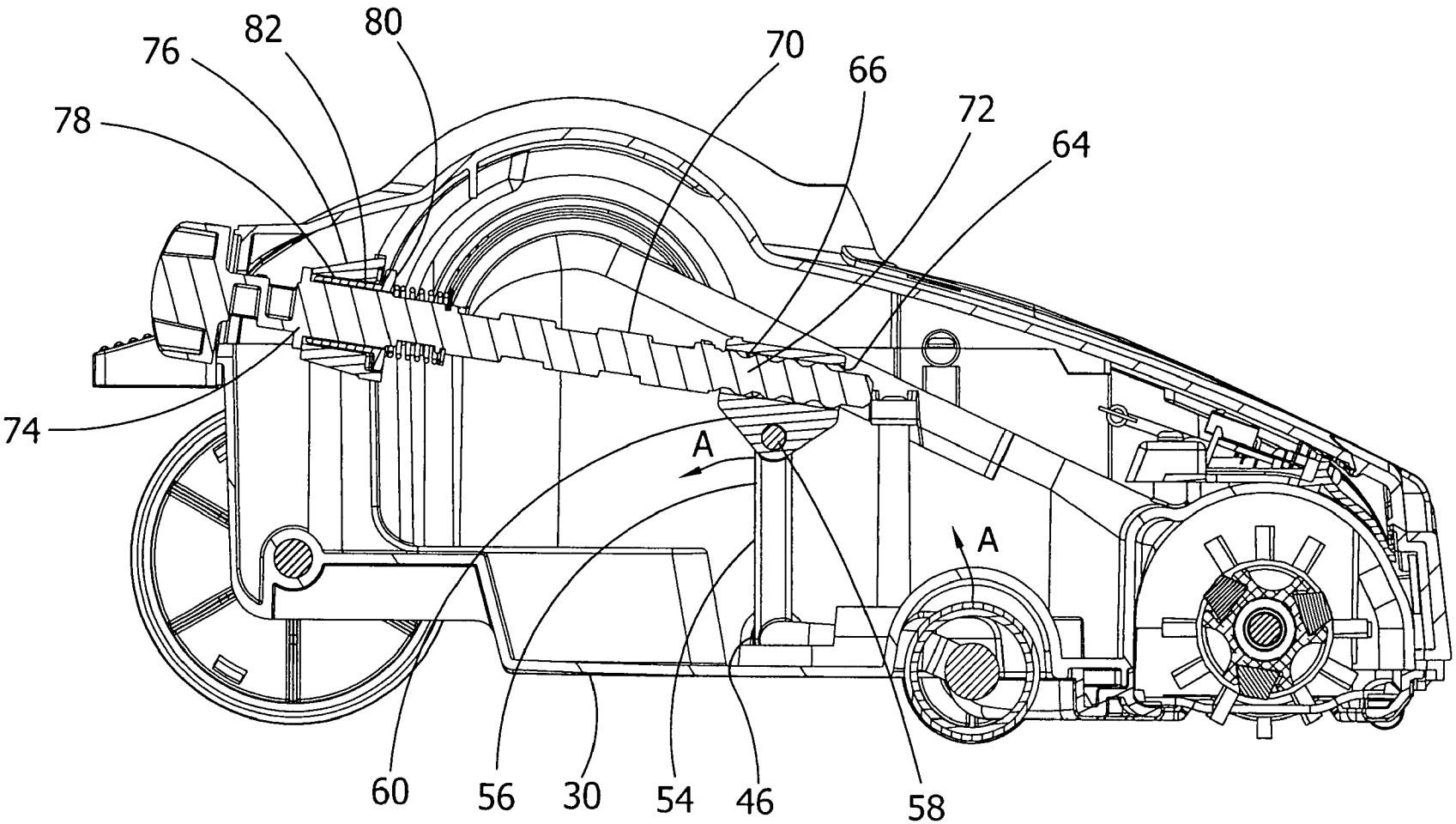
FIG. 5 is an enlarged cross sectional view through the adjustment mechanism and cleaning head of the preferred embodiment, showing the mechanism with the front wheel of the cleaning head in its upper most position.
Figure 6:
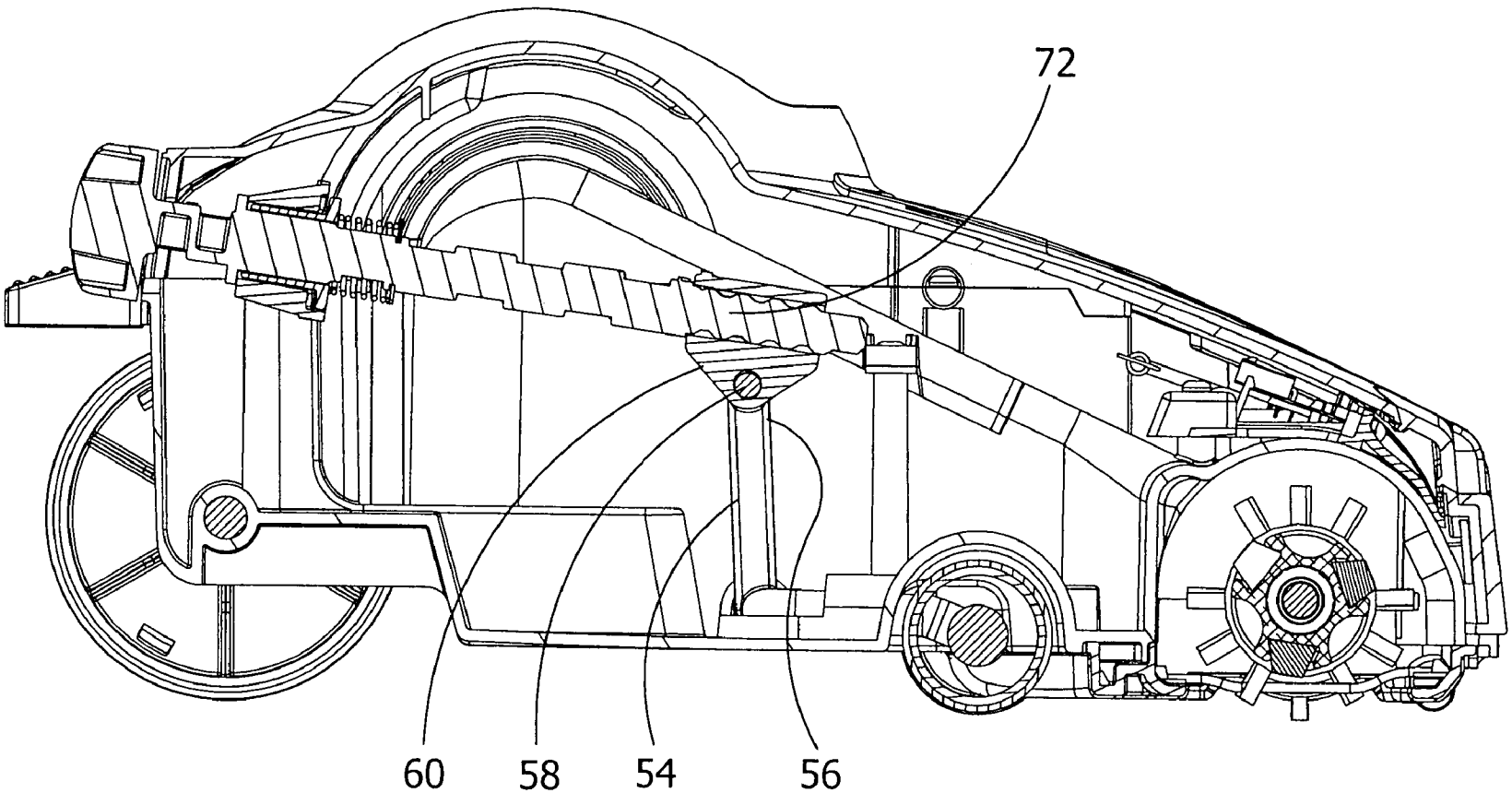
FIG. 6 is a cross sectional view similar to FIG. 5 with the adjustment mechanism and front wheel in its lower most position.

Referring now to the operation of the preferred embodiment, with particular reference to FIGS. 4 and 5, starting with the height adjustment mechanism at its position as shown in FIG. 4 in which the front wheels 22 and 24 are positioned at their lowest or most extended position relative to the cleaning head 16 so that the brush roller 34 is held at its highest position above the surface to be cleaned, the knob 120 is manually rotated counter-clockwise to rotate shaft 70. As shaft 70 is rotated the spring pressure of spring 110 is overcome sufficiently to allow detent 92 to lift out of a corresponding indent 94 while indexing member 80 slides longitudinally along shaft 70 and allows both the shaft 70 and indexing member 80 to be rotated due to the interaction of keys 88 with grooves 86. As shaft 70 is rotated the threads 72 at one end thereof interact with the mating threads 66 in threaded bore 62 in guide member 60, causing guide member 60 to move along shaft 70 to the left as shown in FIGS. 4 and 5. As this occurs, guide member 60 pivots slightly on spindle 58 and causes lever arm 54 to pivot to the left as shown by arrow a on FIG. 5. This, in turn, causes axle 32 to rotate, lifting the wheels 22 and 24 relative to the cleaning head 16.

As knob 120 is rotated, the detent 92 engages in each subsequent indent 94 until rotation of the knob is stopped at which point the detent 92 stays in the indent in which it is positioned at that time and holds the wheels 22 and 24 in the related position relative to the cleaning head 16 and thus positions the brush roller 34 at a related position above the surface to be cleaned. By providing the indicia 121 around the periphery of knob 120 and providing pointer 122, an operator can establish the desired indicia setting, through several uses of the vacuum cleaner, for the desired height of the brush roller 34 for a particular surface being cleaned.

When introducing elements of the present invention or the embodiment(s) thereof, the articles "a," "an," "the," and "said" are intended to mean that there are one or more of the elements. The terms "comprising," "including," and "having" are intended to be inclusive and mean that there may be additional elements other than the listed elements.

As various changes could be made in the above constructions without departing from the scope of the invention, it is intended that all matter contained in the above description or shown in the accompanying drawings shall be interpreted as illustrative and not in a limiting sense.

What is claimed is:

1. A vacuum cleaner height adjustment mechanism, comprising:

a cleaning head having a pair of laterally spaced front wheels and a pair of laterally spaced rear wheels mounted for rotation on the cleaning head for supporting the cleaning head on a floor during vacuum cleaning operations;

the front wheels being mounted to a common axle mounted in the cleaning head for pivotal movement around a fixed axis, the wheels being mounted to the axle offset from the pivotal axis of the axle;

an arm extending from the axle;

a shaft mounted substantially horizontally in the cleaning head for rotation about a central axis disposed in a vertical plane perpendicular to a vertical plane containing the axis of the axle, one end of the shaft having spiral threads thereon and an opposite end having an adjustment knob fixed thereto for manually rotating the shaft;

a guide member having internal threads matching and engaged with the spiral threads on the shaft for movement along the shaft, the guide member being coupled to the arm extending from the axle so as to pivot the axle when the shaft is rotated by rotating the knob, whereby the front wheels are raised or lowered relative to the cleaning head;

an indexing block fixedly secured to the cleaning head and having a cylindrical opening therethrough, the shaft passing through the cylindrical opening in the indexing block;

an indexing member having a central opening through which the shaft extends, the indexing member being fixed to the shaft for rotation therewith; and a spring urging the indexing member into engagement with the indexing block;

the indexing block and the indexing member having at least one cooperating detent and indent disposed radially around the axis of the shaft for holding the shaft in a fixed position after manual rotation.

2. The adjustment mechanism of claim 1 wherein the indexing member has the detent and the indexing block has a plurality of indents radially spaced around its periphery for receiving the detent.

3. A vacuum cleaner height adjustment mechanism, comprising:

a cleaning head having a pair of laterally spaced front wheels and a pair of laterally spaced rear wheels mounted for rotation on the cleaning head for supporting the cleaning head on a floor during vacuum cleaning operations;

the front wheels being mounted to a common axle mounted in the cleaning head for pivotal movement around a fixed axis, the wheels being mounted to the axle offset from the pivotal axis of the axle;

an arm extending from the axle;

a shaft mounted substantially horizontally in the cleaning head for rotation about a central axis disposed in a vertical plane perpendicular to a vertical plane containing the axis of the axle, one end of the shaft having spiral threads thereon and an opposite end having an adjustment knob fixed thereto for manually rotating the shaft;

a guide member having internal threads matching and engaged with the spiral threads on the shaft for movement along the shaft, the guide member being coupled to the arm extending from the axle so as to pivot the axle when the shaft is rotated by rotating the knob, whereby the front wheels are raised or lowered relative to the cleaning head;

the cleaning head having a substantially vertical rear surface; and the knob extending out through the rear surface of the cleaning head so as to be accessible for manual rotation.

4. The adjustment mechanism of claim 1 wherein the axle is generally U-shaped and the front wheels are mounted to opposite ends of the axle.

5. The adjustment mechanism of claim 1 wherein the arm extends radially from the axle.

* * * * *